US008259027B2

(12) United States Patent
Isom et al.

(10) Patent No.: US 8,259,027 B2
(45) Date of Patent: Sep. 4, 2012

(54) DIFFERENTIAL FEED NOTCH RADIATOR WITH INTEGRATED BALUN

(75) Inventors: Robert S. Isom, Allen, TX (US); James M. Irion, II, Allen, TX (US)

(73) Assignee: Raytheon Company, Waltham, MA (US)

( * ) Notice: Subject to any disclaimer, the term of this patent is extended or adjusted under 35 U.S.C. 154(b) by 377 days.

(21) Appl. No.: 12/567,681

(22) Filed: Sep. 25, 2009

(65) Prior Publication Data

US 2011/0074649 A1 Mar. 31, 2011

(51) Int. Cl.
*H01Q 1/50* (2006.01)

(52) U.S. Cl. ..... 343/859

(58) Field of Classification Search ..... 343/767, 343/768, 700 MS, 859
See application file for complete search history.

(56) References Cited

U.S. PATENT DOCUMENTS 4,736,454 A * 4/1988 Hirsch ..... 455/129
5,081,466 A 1/1992 Bitter, Jr.
5,194,875 A 3/1993 Lucas
5,659,326 A * 8/1997 McWhirter et al. ..... 343/770
5,949,382 A 9/1999 Quan
6,008,770 A * 12/1999 Sugawara ..... 343/767
6,219,000 B1 4/2001 McWhirter et al.
6,292,153 B1 * 9/2001 Aiello et al. ..... 343/767
6,501,431 B1 * 12/2002 Irion et al. ..... 343/767
6,963,312 B2 * 11/2005 Schuneman et al. ..... 343/767
7,180,457 B2 2/2007 Trott et al.

* cited by examiner

*Primary Examiner* — Huedung Mancuso
(74) *Attorney, Agent, or Firm* — Christie, Parker & Hale, LLP

(57) ABSTRACT

A differential feed notched radiator. A notched radiator includes a planar dielectric substrate having a first surface and an oppositely facing second surface, and a first conductive layer on the first surface and a second conductive layer on the second surface. The first and second conductive layers are patterned to provide a tapered notch in a first region of the planar dielectric substrate, the tapered notch having a first end and a second end wider than the first end, and the first and second conductive layers patterned to provide a balun in a second region of the planar dielectric substrate, the balun connected with the first end of the tapered notch. A conductive strip for transferring differential signals is embedded in the planar dielectric substrate between the first and second conductive layers, a portion of the conductive strip intersecting a portion of the tapered notch near the first end.

12 Claims, 8 Drawing Sheets

DIFFERENTIAL FEED NOTCH RADIATOR WITH INTEGRATED BALUN

BACKGROUND OF THE INVENTION (a) Field of the Invention

The present invention relates to notch radiators and antenna systems including the same.

(b) Description of the Related Art

Tapered notch radiators (or flared notch radiators) work well as array elements in antenna arrays because they can easily fit within array lattice spacing, possess broad bandwidth despite their small aperture area and can be designed for dual polarization.

Known single feed tapered notch radiators (hereinafter "notch radiator(s)"), with a profile of a third of a wavelength at the lowest operating frequency of the notch radiators, can achieve good scan and match performance, but do not possess the differential rejection desired for high linearity and noise rejection. Known differential feed radiators such as the "bunny ear" or dipole antenna do not provide as much bandwidth as desired by many ultra-wide band (UWB) applications. Other known differential notch radiator designs possessing wider bandwidths such as those disclosed in U.S. Pat. No. 7,180,457, the entirety of which is hereby incorporated by reference, can be complicated in their constructions and do not incorporate an integrated balun as part of the radiator, requiring additional components in the design.

Accordingly, a differential notch radiator design with an integrated balun that is simple in fabrication with reduced mechanical complexity and cost is highly desirable.

SUMMARY OF THE INVENTION

Aspects of exemplary embodiments of the present invention are directed toward a novel implementation of a differential feed notch radiator that results in a significant cost reduction in manufacturing cost compared to alternative designs. A differential feed notch radiator according to the exemplary embodiments maintains excellent bandwidth and scan angle performance in both the E- and H-Planes, and has improved noise rejection and linearity performance compared to other flared notch antennas. Additionally, the novel construction of the differential feed notch radiator according to the exemplary embodiments facilitates reduction of the depth of the notch radiator, thereby reducing the distance from the electronics to the notch radiator.

According to an embodiment of the present invention, a notch radiator includes a planar dielectric substrate having a first surface and an oppositely facing second surface; a first conductive layer on the first surface and a second conductive layer on the second surface, wherein the first and second conductive layers are patterned to provide a tapered notch in a first region of the planar dielectric substrate, the tapered notch having a first end and a second end wider than the first end, and the first and second conductive layers are patterned to provide a balun in a second region of the planar dielectric substrate, the balun connected with the first end of the tapered notch; and a conductive strip for transferring differential signals embedded in the planar dielectric substrate between the first and second conductive layers, a portion of the conductive strip intersecting a portion of the tapered notch near the first end.

According to an embodiment of the present invention, the tapered notch may be substantially symmetrical about a centerline of the planar dielectric substrate.

According to an embodiment of the present invention, the conductive strip may be substantially symmetrical about the centerline of the planar dielectric substrate.

According to an embodiment of the present invention, the conductive strip may be a stripline.

According to an embodiment of the present invention, a side of the balun connected with the first end of the tapered notch may have a width that is greater than a width of the first end of the tapered notch.

According to an embodiment of the present invention, the balun may be shaped to provide a high impedance termination to the tapered notch.

According to an embodiment of the present invention, the notched radiator may further include a plurality of vias to electrically connect the first and the second conductive layers to each other.

According to an embodiment of the present invention, a number of the plurality of vias may be located near edges of the tapered notch.

According to an embodiment of the present invention, a spacing between two of the vias may be about 0.06 inch.

According to an embodiment of the present invention, the conductive strip may have a width about 0.028 inch.

According to an embodiment of the present invention, the portion of the conductive strip intersecting the portion of the tapered notch may be a middle portion of the conductive strip.

According to an embodiment of the present invention, the notched radiator may further include one or more third conductive layers between the first and second conductive layers, the one or more third conductive layers and the first and second conductive layers having a substantially same pattern.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION OF EXEMPLARY EMBODIMENTS

Figure 1:
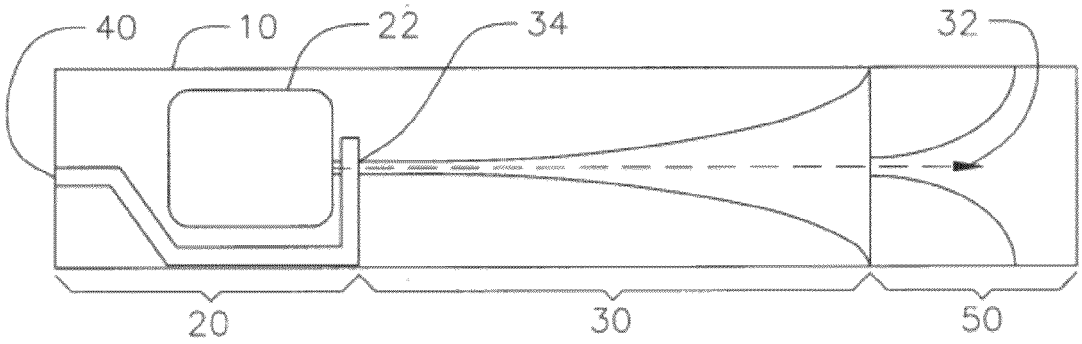
FIG. 1 is a conceptual diagram showing a plan view of a single tapered notch radiator with a single feed.

In the following detailed description, only certain exemplary embodiments of the present invention are shown and described, by way of illustration. As those skilled in the art would recognize, the present invention may be embodied in many different forms and should not be construed as being limited to the embodiments set forth herein. Also, in the context of the present application, when an element is referred to as being "on" another element, it can be directly on the another element or be indirectly on the another element with one or more intervening elements interposed therebetween. Like reference numerals designate like elements throughout the specification.

Aspects of the embodiments of the present invention are directed toward a novel implementation of a differential feed notch radiator (e.g., a flared notch radiating element) with an integrated balun in a single board construction. Two striplines feed the same notch radiator and are electrically connected to each other at the point where they feed the notch radiator. According to the embodiments, these two stripline feeds are fed with out-of-phase signals (or differential signals), producing an effective short circuit to the center of the flared notch feed point that facilitates radiation down the flared notch slots and, additionally, helps reduce cross-polarization. The flared notch portion of the notch radiator is designed to have a suitable depth and taper that provide the desired bandwidths and scan performance, similar to the established design process for single feed flared notch radiators.

The combination of the differential feeds with an integrated balun in a single board (e.g., a printed circuit board) implementation of the differential feed notch radiator facilitates low cost and reduced manufacturing complexity. The differential feed notch radiator according to the embodiments of the present invention can achieve improved performance over the 10:1 bandwidth and scan ranges (e.g., ±60 degrees) over other currently known radiators. The broadband performance of the differential feeds notch radiator according to the embodiments of the present invention is desirable in many applications such as applications requiring high linearity, greater noise cancellation and rejection.

FIG. 1 is a conceptual diagram showing a plan view of a single tapered notch radiator with a single feed.

Referring to FIG. 1, on a dielectric substrate material 10 (e.g., a planar dielectric substrate) with top and bottom conductive layers (e.g., metal layer), the top and bottom conductive layers are patterned to form a balun 22 in a balun section 20 and a tapered notch 30 by suitable methods such as printed circuit board fabrication methods known in the art. Exemplary materials suitable for the dielectric substrate material 10 includes, but not limited to, Arlon CLTE, Rogers 6002 and Rogers 3003. The balun 22 is dimensioned to provide a high impedance termination to the tapered notch 30. A single stripline 40 between the two conductive layers in the balun section 20 crosses the slotline 32 of the tapered notch 30. At a stripline-to-slotline junction 34 wherein the stripline 40 crosses the tapered notch 30, broadband signal transition or transfer between the stripline 40 and the tapered notch 30 takes place. The balun 22 is an open-circuit cavity that prevents 3 dB "back-radiation" loss. The tapered notch 30 functions as a broadband radiating element and provides tapered impedance transition. Dielectric transition is achieved by exponentially tapered routing of the dielectric substrate material, thereby providing further impedance transformation by tapering dielectric constant in a unit cell (or radiator) of an antenna array.

A radome 50 (or an endpiece) is optionally fitted at the end of the tapered notch 30 to protect the tapered notch radiator from the environment. The radome 50 is constructed of a suitable material that minimally attenuates the electromagnetic signals transmitted or received by the tapered notch radiator.

Figure 2:
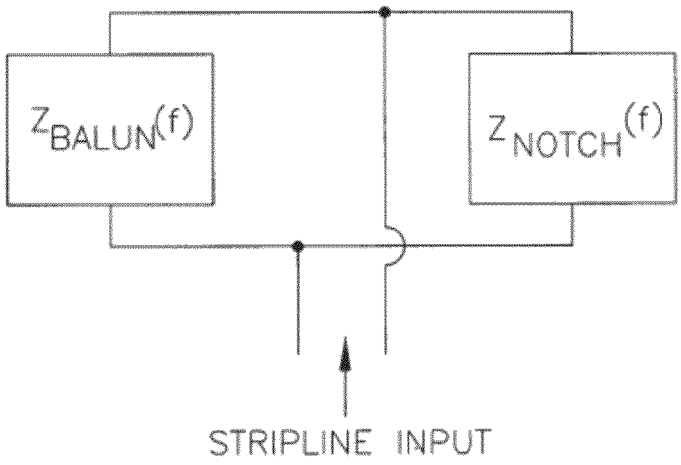
FIG. 2 is a schematic block diagram showing an equivalent circuit of the tapered notch radiator of FIG. 1.

FIG. 2 is a schematic block diagram showing an equivalent circuit of the tapered notch radiator of FIG. 1.

Figure 3:
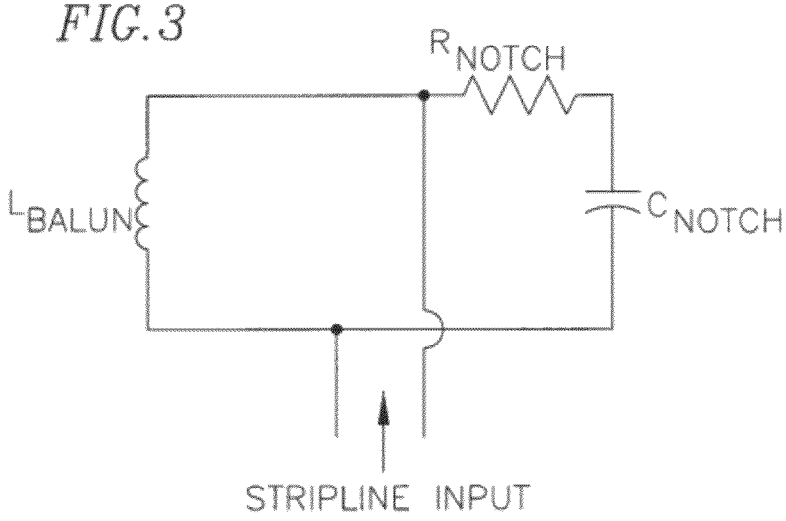
FIG. 3 is a schematic circuit diagram of an LC equivalent circuit of the circuit of FIG. 2 at low-frequency.

In FIG. 1, at the stripline-to-slotline junction 34, the balun 22 and the tapered notch 30 can be represented as $Z_{balun}(f)$ and $Z_{Notch}(f)$, respectively in FIG. 2, as a parallel impedance combination. As such, the impedances of both balun 22 and the tapered notch 30 depend on the frequency of the signal. At low frequencies, the balun 22 is inductive, and the tapered notch 30 is capacitive. FIG. 3 is a schematic circuit diagram of an LC equivalent circuit of the circuit of FIG. 2 at low-frequencies. As shown in FIG. 3, the balun 22 is modeled as an inductive element $L_{Balun}$, and the tapered notch 30 is modeled as a capacitive element $C_{notch}$ in series with a resistive element $R_{Notch}$. To improve low frequency impedance matching, the balun 22 and the tapered notch 30 are designed for conjugate matching similar to tuning a RLC circuit. For circuit analysis, the tapered notch radiator of FIG. 1 can be separated into its components to reduce the time required for its analysis and optimization.

Figure 4A:
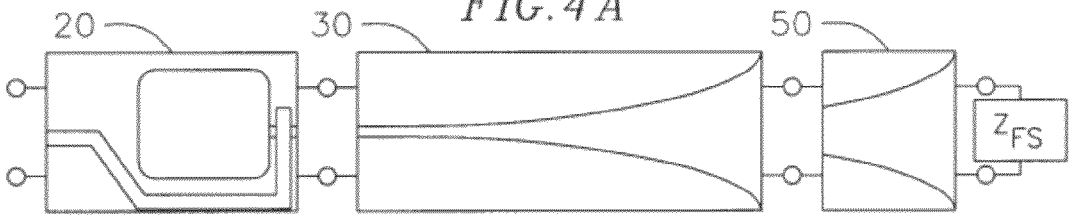
FIG. 4*a* is a schematic block diagram showing the tapered notch radiator of FIG. 1 partitioned into components.
Figure 4B:
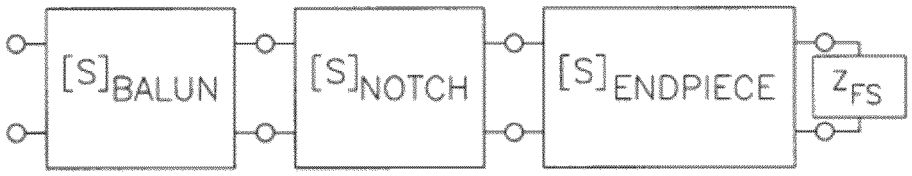
FIG. 4*b* is a schematic block diagram showing the components of the tapered notch radiator of FIG. 1 in S-matrices.
Figure 4C:
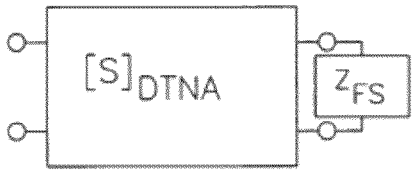
FIG. 4*c* is a schematic block diagram showing an optimized element S-matrix of the tapered notch radiator of FIG. 1.

FIG. 4*a* is a schematic block diagram showing the tapered notch radiator of FIG. 1 partitioned into its components. FIG. 4*b* is a schematic block diagram showing the components represented as S-matrices. As shown in FIG. 4*b*, the balun, notch and endpiece S-matrices are cascaded together to yield an element S-matrix of the entire tapered notch radiator of FIG. 1. FIG. 4*c* is a schematic block diagram showing an optimized element S-matrix of the tapered notch radiator of FIG. 1. While rigorous analysis of the entire tapered notch radiator of FIG. 1 is computationally expensive, the separation of components as shown in FIGS. 4*a* and 4*b* allows for faster solve time.

Figure 5A:
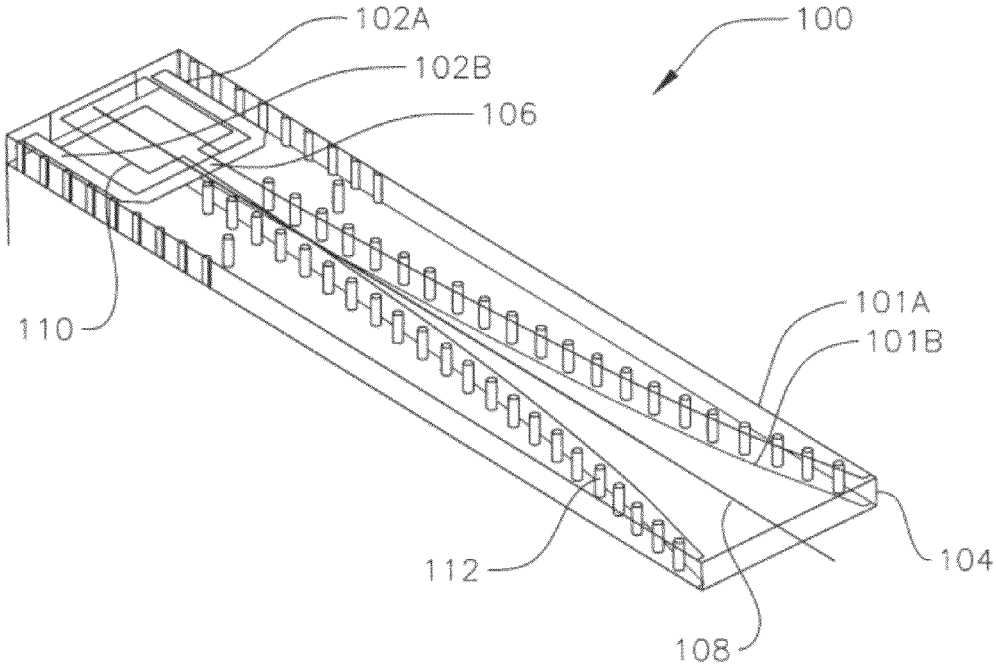
FIG. 5*a* is a conceptual diagram showing a perspective view of a differential feed tapered notch radiator according to an embodiment of the present invention.
Figure 5B:
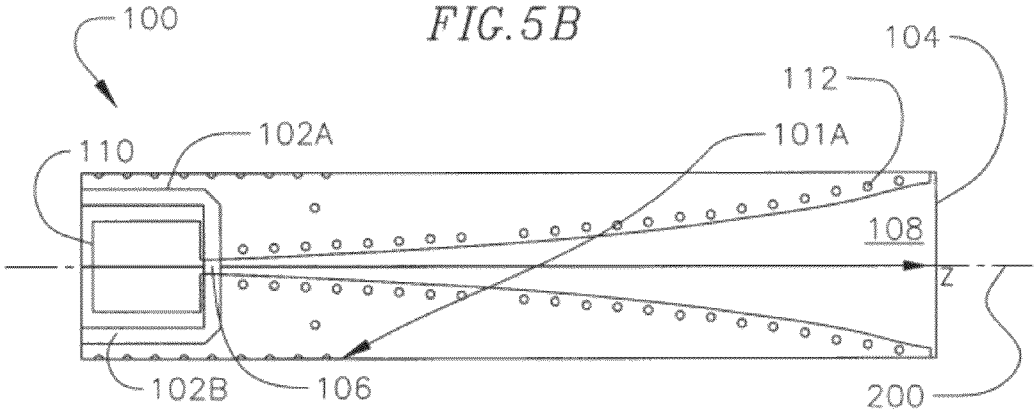
FIG. 5*b* is a conceptual diagram showing a plan view of the differential feed tapered notch radiator of FIG. 5*a*.

FIG. 5*a* is a conceptual diagram showing a perspective view of a differential feed tapered notch radiator 100 according to an embodiment of the present invention. FIG. 5*b* is a conceptual diagram showing a plan view of the differential feed tapered notch radiator of FIG. 5*a*.

Referring to FIG. 5*a*, two striplines 102*a* and 102*b* are embedded in a dielectric substrate 104 (e.g., a planar dielectric substrate) between two conductive layers 101*a* and 101*b* (e.g., metal layers) 101*a* and 101*b*. The two conductive layers 101*a* and 101*b* are patterned to provide a tapered notch 108 with a wide open end and a narrow close end connected to a balun 110. The two striplines 102*a* and 102*b* are connected to each other near the narrow close end of the tapered notch 108. The balun 110 provides a high impedance termination to direct energy toward the wide open end of the tapered notch 108. The dielectric substrate 104 can be constructed of, but not limited to, Arlon CLTE, Rogers 6002 and Rogers 3003. The two striplines 102*a* and 102*b* carry signals that are 180 degree out of phrase. Therefore, an effective short is produced to a feedpoint 106 of the notch radiator 100, and the above described construction helps to eliminate or reduce cross-polarization components and provides an effective path to couple the energy into the tapered notch 108.

In an embodiment of the present invention, the two striplines 102*a* and 102*b* are substantially symmetrical about a centerline 200 of the dielectric substrate 104.

In an embodiment of the present invention, the tapered notch 108 is substantially symmetrical about the centerline 200 of the dielectric substrate 104.

In an embodiment of the present invention, the differential feed tapered notch radiator 100 includes a plurality of vias 112 to electrically connect the two conductive layers 101*a* and 101*b* to each other as mode suppression vias. In an embodiment of the present invention, a number of the plurality of vias 112 are located near edges of the tapered notch 108. The vias is spaced less than one eighth of a wavelength apart with the wavelength being defined as the wavelength of the highest frequency in the dielectric substrate. In an embodiment of the present invention, a spacing between two of the vias is about 0.06 inch.

In an embodiment of the present invention, each of the striplines 102*a* and 102*b* has a suitable line width for a 50 Ohm impedance, but may be raised or lowered to meet different radiator or system requirements. In an embodiment, the line width of the stripline is about 0.028 inch.

In other embodiments of the present invention, one or more additional conductive layers may be interposed between the conductive layers 101*a* and 101*b*. The one or more additional conductive layers and the conductive layers 101*a* and 101*b* are patterned to have a substantially similar pattern.

Figure 5C:
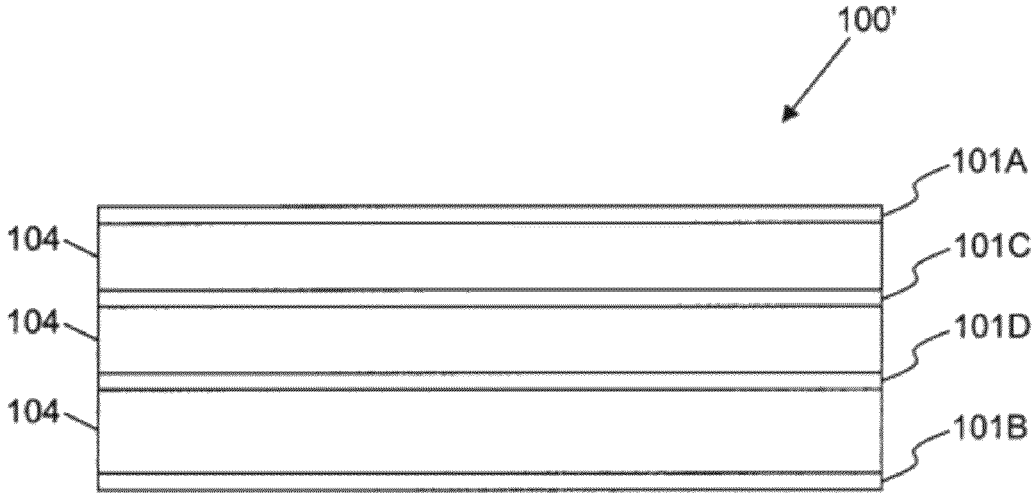
FIG. 5*c* is a conceptual diagram showing a cross-sectional view of a differential feed tapered notch radiator according to an embodiment of the present invention.
Figure 6A:
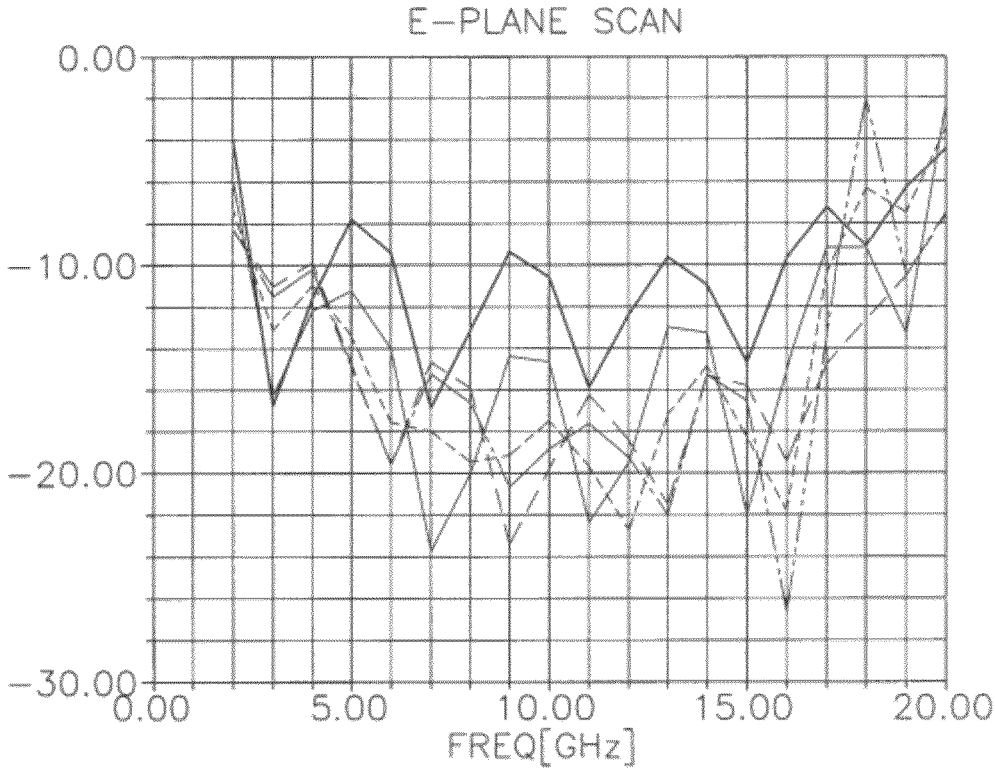
FIGS. 6*a*, 6*b*, 6*c* and 6*d* are graphs showing the simulation results of four exemplary differential feed tapered notch radiators having lengths of 1.5", 1.2", 1" and 0.75" according to embodiments of the present invention.
Figure 6A:
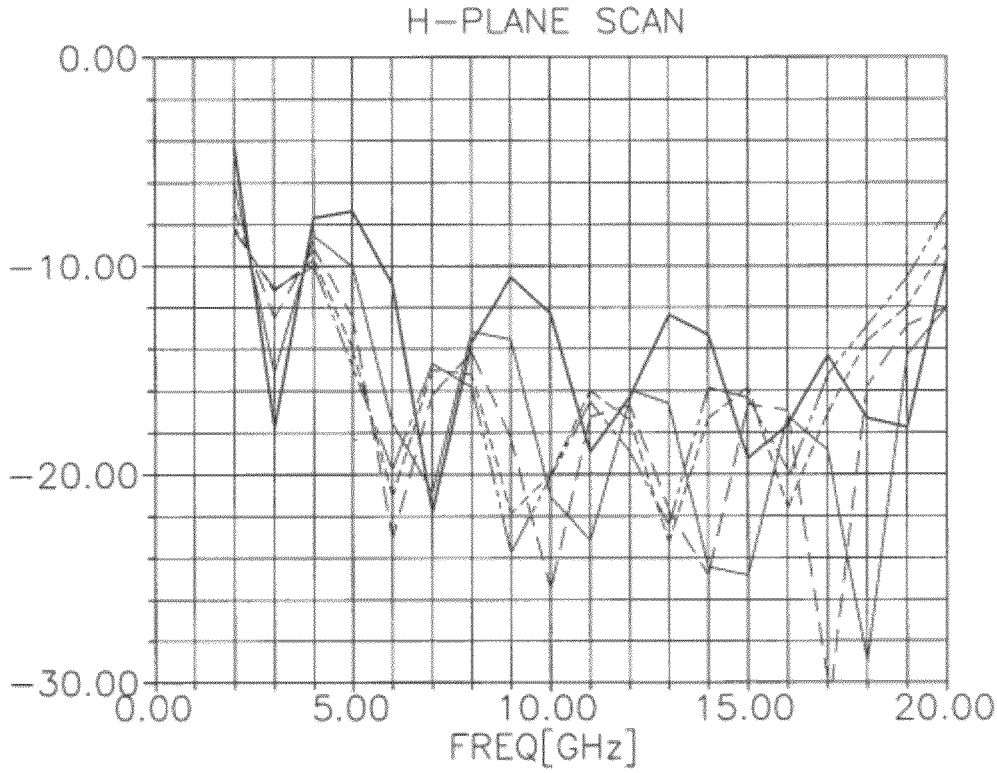
Figure 6B:
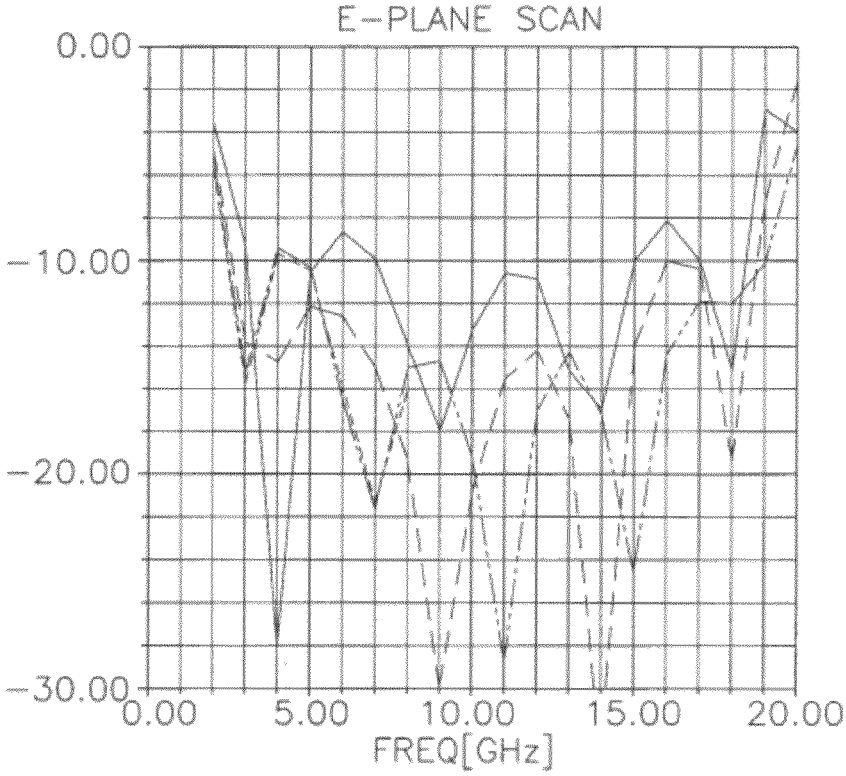
Figure 6B:
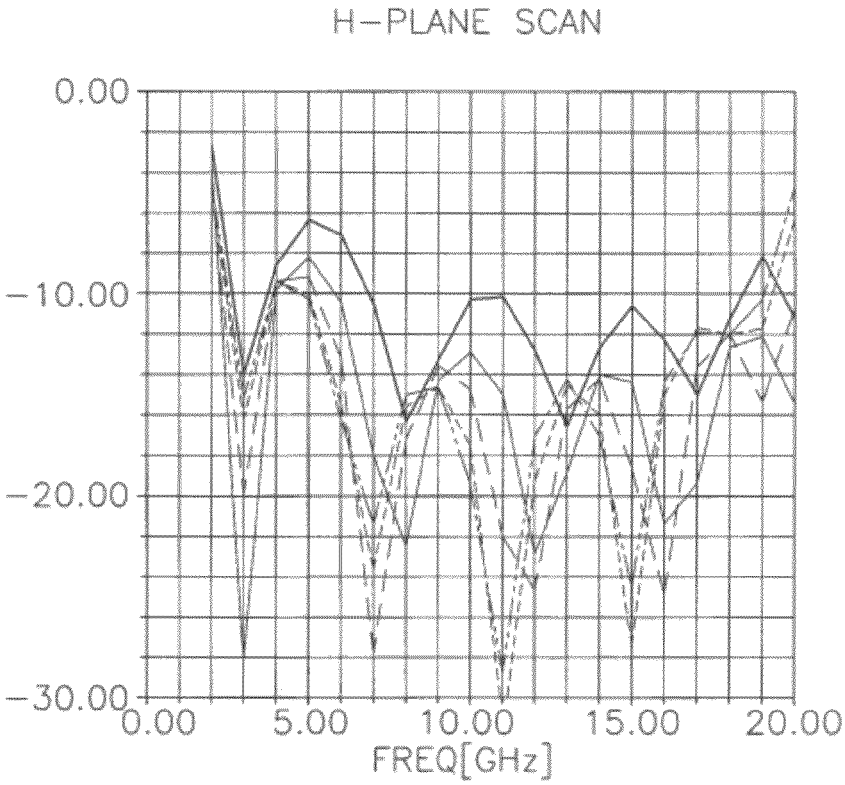
Figure 6C:
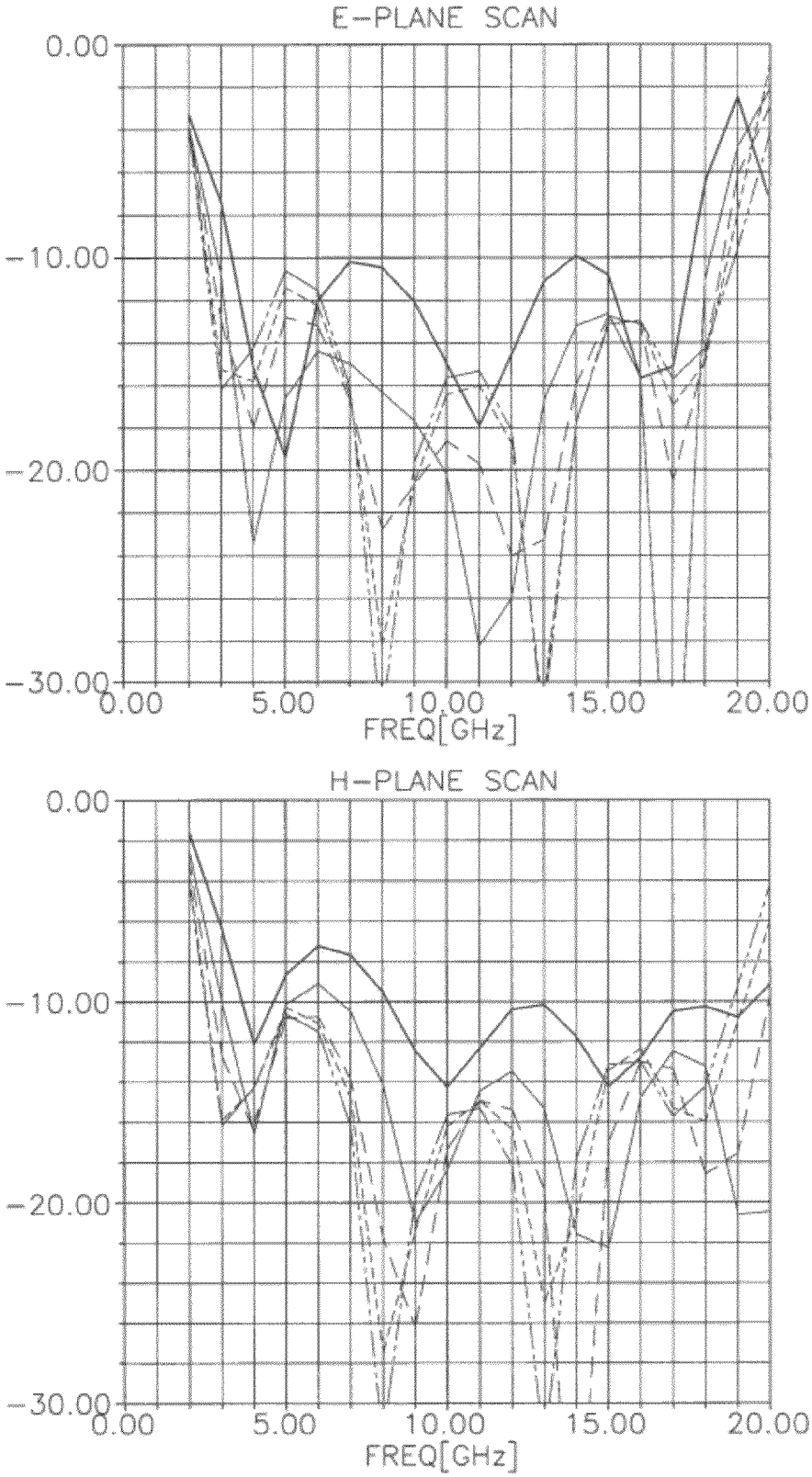
Figure 6D:
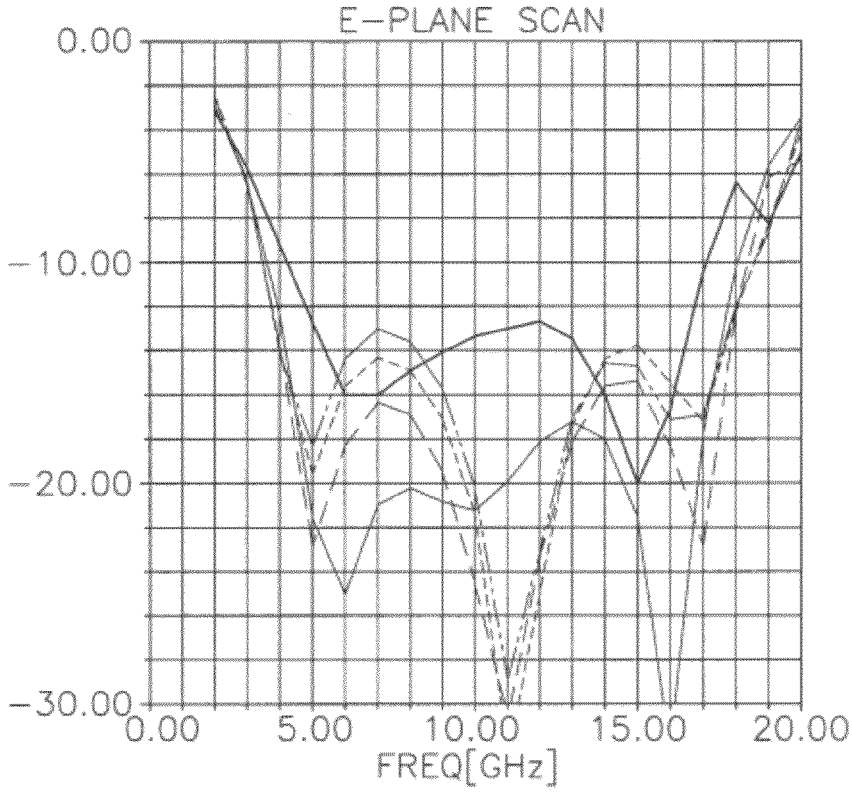
Figure 6D:
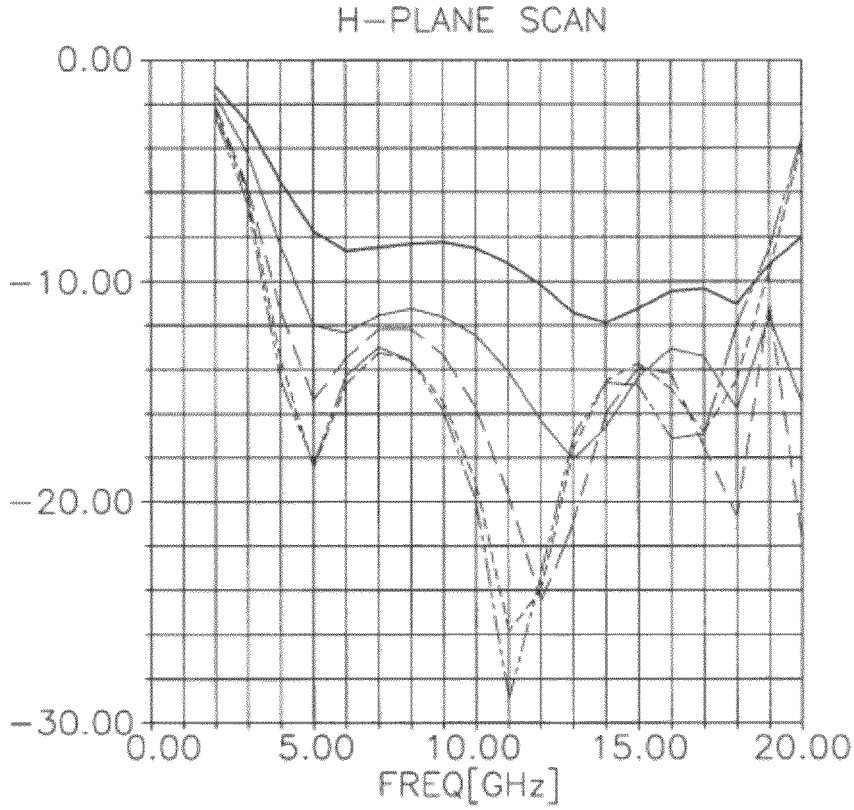

FIG. 5*c* is a conceptual diagram showing a cross-sectional view of a differential feed tapered notch radiator 100' according to an embodiment of the present invention. This embodiment is substantially similar to the embodiment of FIG. 5*a*, except for the addition of conductive layers 101*c* and 101*d*. The conductive layers 101*c* and 101*d* are patterned to have substantially the same shape as the conductive layers 101*a* and 101*b*.

Simulation Results of Exemplary Embodiments

FIGS. 6*a*, 6*b*, 6*c* and 6*d* are graphs showing simulation results of active return loss of four exemplary differential feed tapered notch radiators having lengths of 1.5", 1.2", 1" and 0.75". The simulation results shown in FIGS. 6*a*-6*d* can be simulated in a high frequency structural simulator (HFSS) or other suitable simulators. During the simulations, the ports of the differential feed tapered notch radiators are driven with equal amplitude and 180 degree out of phase signals. The X-axis of the diagrams denotes frequency of the signal in GHz, and the Y-axis of the diagrams denotes active return loss in dB.

A differential feed tapered notch radiator according to the above described exemplary embodiments offers reduced insertion loss in front of the LNA by providing an integrated 0°/180°balun as part of the radiating element. This can improve insertion loss by about 1.5 dB, thereby improving noise figure by that amount.

Additionally, the differential feed tapered notch radiator according to the above described exemplary embodiments allows for a more compact design by eliminating the need for a balun in addition to the radiator element. Furthermore, the differential feed tapered notch radiator according to the exemplary embodiments can be applied in high linearity systems to improve noise figure and IP2H performance.

According to the above described exemplary embodiments, the combination of the differential feeds with an integrated balun in a single board radiator design facilitates low cost and reduced manufacturing complexity.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A notched radiator comprising:

a planar dielectric substrate having a first surface and an oppositely facing second surface;

a first conductive layer on the first surface and a second conductive layer on the second surface, wherein the first and second conductive layers are patterned to provide a tapered notch in a first region of the planar dielectric substrate, the tapered notch having a first end and a second end wider than the first end, and the first and second conductive layers patterned to provide a balun in a second region of the planar dielectric substrate, the balun connected with the first end of the tapered notch; and a conductive strip embedded in the planar dielectric substrate between the first and second conductive layers, the conductive strip comprising two different ends configured to transfer differential signals, a portion of the conductive strip intersecting a portion of the tapered notch near the first end.

2. The notched radiator in accordance with claim 1, wherein the tapered notch is substantially symmetrical about a centerline of the planar dielectric substrate.

3. The notched radiator in accordance with claim 2, wherein the conductive strip is substantially symmetrical about the centerline of the planar dielectric substrate.

4. The notched radiator in accordance with claim 1, wherein the conductive strip is a stripline.

5. The notched radiator in accordance with claim 1, wherein a side of the balun connected with the first end of the tapered notch has a width that is greater than a width of the first end of the tapered notch.

6. The notched radiator in accordance with claim 1, wherein the balun is shaped to provide a high impedance termination to the tapered notch.

7. The notched radiator in accordance with claim 1, further comprising a plurality of vias to electrically connect the first and the second conductive layers to each other.

8. The notched radiator in accordance with claim 7, wherein a number of the plurality of vias are located near edges of the tapered notch.

9. The notched radiator in accordance with claim 7, wherein a spacing between two of the vias is about 0.06 inch.

10. The notched radiator in accordance with claim 1, wherein the conductive strip has a width about 0.028 inch.

11. The notched radiator in accordance with claim 1, wherein the portion of the conductive strip intersecting the portion of the tapered notch is a middle portion of the conductive strip.

12. The notched radiator in accordance with claim 1, further comprising one or more third conductive layers between the first and second conductive layers, the one or more third conductive layers and the first and second conductive layers having a substantially same pattern.

* * * * *